United States Patent [19]

Paisley

[11] Patent Number: 5,029,528

[45] Date of Patent: Jul. 9, 1991

[54] FIBER OPTIC MOUNTED LASER DRIVEN FLYER PLATES

[75] Inventor: Dennis L. Paisley, Santa Fe, N. Mex.

[73] Assignee: The United States of America as represented by the United States Department of Energy, Washington, D.C.

[21] Appl. No.: 502,960

[22] Filed: Apr. 2, 1990

[51] Int. Cl.[5] ..... F42C 19/00

[52] U.S. Cl. ..... 102/201

[58] Field of Search ..... 102/201; 376/125, 152

[56] References Cited

U.S. PATENT DOCUMENTS

| | | | |
|---|---|---|---|
| 3,362,329 | 1/1968 | Epstein | 102/201 |
| 3,408,937 | 11/1968 | Lewis et al. | 102/201 |
| 3,528,372 | 9/1970 | Lewis et al. | 102/201 |
| 3,812,783 | 5/1974 | Yang et al. | 102/201 |
| 4,343,242 | 8/1982 | Welk | 102/201 |
| 4,870,903 | 10/1989 | Carel et al. | 102/201 |
| 4,917,014 | 4/1990 | Loughry et al. | 102/201 |

OTHER PUBLICATIONS

M. E. Kipp, R. E. Setchell and P. A. Taylor, "Homogeneous Reactive Kinetics Applied to Grandular HNS," Shock Waves in Condensed Matter, pp. 539–542 (1987).

V. P. Ageev, A. D. Akhsakhalyan, S. V. Gapono, A. A. Gorbunov, V. I. Konov, and V. I. Lucin, "Influence of the Wavelength of Laser Radiation on the Energy Composition of an Ablation Plasma," published in the Soviet, Phys. Thec. Thys., vol. 33, No. 5, pp. 562–565 (May 1988).

S. A. Sheffield and G. A. Fisk, "Particle Velocity Measurements of Laser-Induced Shock Waves Using ORVIS," Proceedings of SPIE, vol. 427, p. 193 (Aug. 1983).

S. A. Sheffield, J. W. Rogers, Jr., and J. N. Castaneda, "Velocity Measurements of Laser-Driven Flyers," American Phys. Society (1985), Topical Conference on Shock Waves in Condensed Matter (Jul. 1985).

S. A. Sheffield and G. A. Fisk, "Particle Velocity Measurements in Laser Irradiated Foils Using ORVIS", published in Shockwaves in Condensed Matter, Chapter VI:7 (1983).

S. P. Obenschain, R. R. Whitlock, E. A. McLean and B. H. Auerbach, "Uniform Ablative Acceleration of Targets by Laser Irradiation at $10^{14}$ W/cm$^2$," Physical Review Letters, vol. 50, No. 1, pp. 44–48 (Jan. 1983).

J. Grun, S. P. Obenschain, B. H. Ripin, R. R. Whitlock, E. A. McLean, J. Gardner, M. J. Herbst, and J. A. Stamper, "Ablative Acceleration of Planar Targets to High Velocities," published in *Phys. Fluids*, vol. 26, No. 2, pp. 588–597 (Feb. 1983).

D. D. Bloomquist and S. A. Sheffield, "Optically Recording Interferometer for Velocity Measurements with Subnanosecond Resolution," J. Appl. Phys., vol. 54, No. 4 (Apr. 1983).

F. Cottet and J. P. Romain, "Formation and Decay of Laser-Generated Shock Waves," Phys. Review A, vol. 25, No. 1, pp. 576–579 (Jan. 1982).

B. H. Ripin, R. Decoste, S. P. Obenschain, S. E. Bodner, E. A. McLean, F. C. Yount, R. R. Whitlock, C. M. Armstrong, J. Grun, J. A. Stamper, S. H. Gold, J. Nagel, R. H. Lehmberg, and J. M. McMahon, "Laser--Plasma Interaction and Ablative Acceleration of this (List continued on next page.)

*Primary Examiner*—Charles T. Jordan

*Attorney, Agent, or Firm*—Milton D. Wyrick; Paul D. Gaetjens; William R. Moser

[57] ABSTRACT

A laser driven flyer plate where the flyer plate is deposited directly onto the squared end of an optical fiber. The plasma generated by a laser pulse drives the flyer plate toward a target. In another embodiment, a first metal layer is deposited onto the squared end of an optical fiber, followed by a layer of a dielectric material and a second metal layer. The laser pulse generates a plasma in the first metal layer, but the plasma is kept away from the second metal layer by the dielectric layer until the pressure reaches the point where shearing occurs.

9 Claims, 1 Drawing Sheet

OTHER PUBLICATIONS

Foils at $10^{12}$–$10^5$ W/cm$^2$," Phys. Fluids, vol. 23, No. 5, pp. 1012–1026 (May, 1980).

L. R. Veeser, J. C. Solem and A. J. Lieber, "Impedance-Match Experiments Using Laser-Driven Shock Waves," Appl. Phys. Lett., vol. 35, No. 10, pp. 761–763 (Nov. 1979).

R. J. Trainor, J. W. Shaner, J. M. Auerbach, and N. C. Holmrd, "Ultrahigh-Pressure Laser-Driven Shock--Wave Experiments in Aluminum," Phys. Review Letters, vol. 42, No. 17, pp. 1154–1157 (Apr. 1979).

B. P. Fairand and A. H. Clauer, "Laser Generation of High-Amplitude Stress Waves in Materials," J. Appl. Phys., vol. 50, No. 3, pp. 1497–1502 (Mar. 1979).

P. Krehl, F. Schwirzke and A. W. Cooper, "Correlation of Stress-Wave Profiles and the Dynamics of the Plasma Produced by Laser Irradiation of Plane Solid Targets," J. Appl. Phys., vol. 46, No. 10, pp. 4400–4406.

S. A. Sheffield, J. W. Rogers, and J. N. Castaneda, "Velocity Measurements of Laser-Driven Flyers Back by High Impedance Windows," Shock Waves in Condensed Matter, pp. 541–546 (1986).

D. L. Paisley, N. I. Montoya, D. B. Stahl and I. A. Garcia, "Interferometry and High Speed Photography of Laser-Driven Flyer Plates," Los Alamos National Laboratory document LA-UR-89-2657 (submitted to SPIE, High Speed Photography and Photonics).

D. L. Paisley, "Laser-Driven Miniature Flyer Plates for Shock Initiation of Secondary Explosives," Los Alamos National Laboratory document LA-UR-8-9-2723 (submitted to APS-Shock Waves in Condensed Matter-1989, Albuquerque, N. Mex., Aug. 14–17 1989).

FIBER OPTIC MOUNTED LASER DRIVEN FLYER PLATES

The invention is a result of a contract with the Department of Energy (Contract No. W-7405-ENG-36).

BACKGROUND OF THE INVENTION

The present invention relates to the field of flyer plates, and, more specifically, to flyer plates launched directly from the ends of optical fibers.

Flyer plates have been used for detonating explosives since their invention in the late 1960's. Originally, these flyer plates were electrically operated, utilizing an electrically produced plasma to accelerate the plate. It was subsequently discovered, after development of the laser, that laser induced plasmas could be used for plate acceleration.

Current laser initiated explosives or energetic materials operate by either of two methods: thermal runaway, or exploding a metal film to generate a high temperature in a manner similar to an exploding bridgewire. The first of these, thermal runaway, is a slow process requiring a period ranging from several hundred microseconds to several milliseconds to attain plate acceleration. Additionally, thermal runaway requires the addition of undesirable additives to the energetic material in order to reduce energy and thermal requirements to a practical level. The second, the exploding metal film, is effective for detonation of low density (~0.5 Theoretical Maximum Density-TMD) secondary explosives, but is not effective to produce detonation at reasonable energies for high density (~0.9 TMD) explosives.

There is currently significant interest in inertial confinement fusion, where large amounts of energy are directed at a sphere of fuel. Although laser beams are now being used in testing, it is conceivable that multiple flyer plates could be shot at the fuel sphere, or that an imploding flyer plate could be on the fuel sphere. The flyer plate may reduce or eliminate the pre-heat problem with large, high power lasers. The invention also finds application in one-dimensional impact of metals or other materials used in shock physics and high strain rate materials research.

The basic prior process for accelerating foils by laser beams involves focusing a laser beam on a free-standing foil in order to convert a portion of the thickness of the foil into a plasma. This plasma will drive a segment of the foil toward a target. Conventional laser interaction with metals produces penetration of the laser beam into the metal of only a few hundred angstroms. The energy deposited in the metal by the laser results in formation of a plasma within a few ns, which plasma drives a flyer plate toward a target.

This process, although effective in settings where laser, focusing lens and free standing foil can all be located in reasonably close proximity is not amenable to use in harsh environments, where equipment such as lasers would not be suitable. It is also not suitable for all geometries, as when sufficient access to the foil is not possible. Additionally, when the laser is used in outside or unsecured applications, it is susceptible to damage and perhaps even false initiation. The present invention overcomes such drawbacks by launching flyer plates directly from the end of an optical fiber, allowing the plate to be launched from positions inaccessible to and remote from the laser light source.

It is therefore an object of the present invention to provide plate launching apparatus that can be used in hostile environments.

It is an additional object of the present invention to provide flyer plates that can be launched from positions which are remote from the laser source.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus of this invention comprises an optical fiber having proximal and distal ends. A laser is connected to the proximal end of the optical fiber, and a metallic layer is deposited onto the distal end.

In a further aspect of the present invention, and in accordance with its objects and purposes, apparatus for producing a flyer plate from laser irradiation comprises an optical fiber having proximal and distal ends, a laser being coupled to the proximal end. A first metallic layer is deposited on the distal end of the optical fiber, and a dielectric material is deposited on the first metallic layer. A second metallic layer is deposited on the dielectric material.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION

Figure 1:
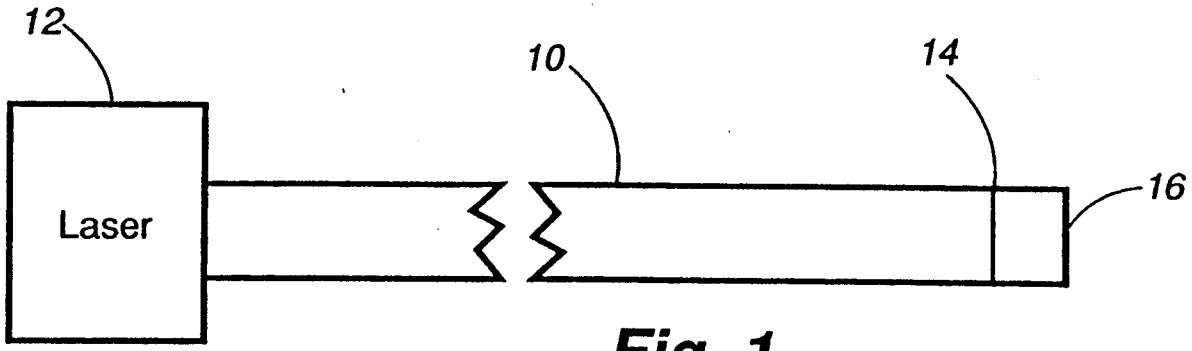
FIG. 1 is a cross-sectional view of one embodiment of the invention wherein a single metallic layer overlays the squared end of an optical fiber.

Referring first to FIG. 1, there can be seen a cross-section of one embodiment of the present invention in which optical fiber 10 is shown coupled to the output of laser 12. Laser 12 can be any one of numerous lasers. The primary requirement is that it can output approximately 20–300 mJ in pulse durations of approximately 5–30 ns, so that approximately 0.75–4.0 $GW/cm^2$ is delivered.

At the opposite end of optical fiber 10 is squared end 14. To form a fiber optic mounted flyer plate, a thin layer 16 of metal is simply deposited on end 14. The thickness of layer 16 can be adjusted according to the application, but thicknesses on the order of several microns are suitable for most purposes.

Prior art-laser initiated flyer plate systems generally coupled laser energy through a lens and an optically transparent substrate to a conventional foil. The laser energy transforms the foil on which it is incident to a plasma, creating high temperature and pressure between the foil and the substrate. When the pressure is sufficiently great, a plug of the foil will break free and be launched toward a target.

The present invention accomplishes the same functions in a much simpler and more versatile manner. With layer 16 being applied directly to end 14 of optical fiber 10, laser 12 will launch the entire surface of layer 16 toward a target. As there is no requirement for a coupling lens or for a transparent substrate, the present invention can be used in applications which are remote from laser 12.

For this to occur, all that is necessary is that laser 12 deliver approximately 0.75–4.0 $GW/cm^2$ at the interface between end 14 of optical fiber 10, and layer 16. In a few ns, this will create a plasma of a portion of layer 16, resulting in a pressure of approximately 5–20 Kbar, or greater. Layer 16 then yields, and is launched toward a target.

Although this embodiment is most effective for many applications, another embodiment, the basis of which is disclosed in my copending application, Ser. No. 502,956 filed Apr. 2, 1990, will provide higher energy flyer plates from the current invention. This is because, with single layer flyer plates, the plasma consumes a portion of the flyer plate, causing the mass of the flyer plate to be lessened and unknown.

Figure 2:
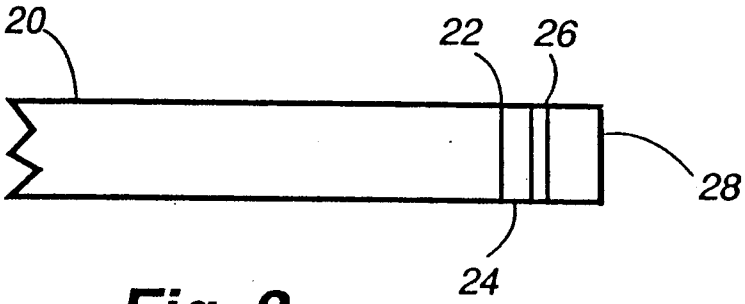
FIG. 2 is a cross-sectional view of another embodiment of the present invention in which the squared end of an optical fiber is first coated with a layer of metal, then with a dielectric layer, and finally with another layer of metal.

Referring now to FIG. 2, there can be seen optical fiber 20 having end 22. Deposited onto end 22 is metal layer 24 of a metal such as aluminum. The thickness of layer 24 can be a few microns. It is a portion of layer 24 which will be converted into a plasma. Next, dielectric layer 26 is deposited onto metal layer 24 to a few tenths of a micron thick. Most any dielectric can be used, although aluminum oxides have proven to be effective. However, dielectric layer 26 need have only a high ionization potential, high shear strength, and low thermal conductivity.

Finally, flyer plate 28 is deposited onto dielectric layer 26. Flyer plate 28 is also a metal layer, thicker than metal layer 24, on the order of a few microns. Flyer plate 28 can also conveniently be aluminum, although other metals are acceptable.

In each of these embodiments, the layers can be applied in any convenient manner. For example, the layers can be applied by physical vapor deposition (PVD) or by sputtering. It is to be recognized FIGS. 1 and 2 are not drawn to any scale, and that the relative thicknesses of the fiber and the deposited layers are exaggerated for clarity. In operation, a laser pulse in optical fiber 20 will create a plasma from a portion of metal layer 24 at the interface between end 22 and metal layer 24. However, due to the characteristics of dielectric layer 26, the plasma will be isolated from flyer plate 28, assuring that the total mass of flyer plate 28 will be launched toward a target. This results in greater velocity for flyer plate 28, as well as having greater kinetic energy applied to the target.

The foregoing description of the preferred embodiments of the invention have been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A laser driven flyer plate comprising:

a. a laser;

b. an optical fiber having proximal and distal ends, said proximal end being connected to said laser;

c. a metal layer deposited on said distal end of said optical fiber.

2. The laser driven flyer plate as described in claim 1, wherein said metal layer comprises aluminum.

3. The laser driven flyer plate as described in claim 1, wherein said laser has an output power of between 20–300 mJ in pulse durations of approximately 5–30 nsec.

4. The laser driven flyer plate as described in claim 1, wherein said metal layer is deposited on said distal end of said optical fiber by physical vapor deposition.

5. A laser driven flyer plate comprising:

a. a laser;

b. an optical fiber having proximal and distal ends, said proximal end being connected to said laser;

c. a first metal layer deposited on said distal end of said optical fiber;

d. a dielectric material deposited on said first metal layer; and e. a second metal layer deposited on said dielectric material.

6. The laser driven flyer plate as described in claim 5, wherein said first and second metal layers comprise aluminum.

7. The laser driven flyer plate as described in claim 5, wherein said dielectric material comprises aluminum oxide.

8. The laser driven flyer plate as described in claim 5, wherein said first and second metal layers and said dielectric layer are deposited by physical vapor deposition.

9. The laser driven flyer plate as described in claim 5, wherein said laser has an output power of between 20–300 mJ in pulse durations of approximately 5–30 nsec.

* * * * *